US005259096A

United States Patent [19]

Grant

[11] Patent Number: 5,259,096

[45] Date of Patent: Nov. 9, 1993

[54] SLIDE SOCKET AND METHOD FOR MAKING SAME

[75] Inventor: Stephen P. Grant, Long Grove, Ill.

[73] Assignee: Athletic Specialties, Inc., Arlington Heights, Ill.

[21] Appl. No.: 949,292

[22] Filed: Sep. 22, 1992

[51] Int. Cl.[5] ..... A44B 17/00

[52] U.S. Cl. ..... 24/324; 29/453

[58] Field of Search ..... 24/324, 673-676; 29/453, 525, 235

[56] References Cited

U.S. PATENT DOCUMENTS

| | | | |
|---|---|---|---|
| 740,518 | 10/1903 | Booth | 24/674 |
| 873,128 | 10/1907 | Holmes . | |
| 887,209 | 5/1908 | Mattson . | |
| 1,300,338 | 4/1919 | Bourque | 24/675 |
| 1,712,976 | 5/1929 | Blair . | |
| 1,947,424 | 2/1934 | Reiter et al. | 24/324 |
| 2,693,625 | 11/1954 | Van Buren, Jr. . | |
| 2,867,811 | 1/1959 | Jones . | |
| 3,237,257 | 3/1966 | Forsberg . | |
| 3,750,094 | 7/1973 | Zenkich | 24/676 X |
| 4,908,916 | 3/1990 | Berte . | |

FOREIGN PATENT DOCUMENTS

| | | | |
|---|---|---|---|
| 489337 | 1/1930 | Fed. Rep. of Germany | 24/324 |
| 652699 | 11/1937 | Fed. Rep. of Germany | 24/324 |
| 451566 | 4/1913 | France | 24/673 |
| 305678 | 2/1929 | United Kingdom | 24/324 |

OTHER PUBLICATIONS

Schutt Athletic Sales Company-1 page brochure re Plastic Buckle no date provided.

*Primary Examiner*—James R. Brittain

*Attorney, Agent, or Firm*—Jansson & Shupe, Ltd.

[57] ABSTRACT

An aspect of the invention is directed to a method for making an improved slide socket of the type having a snap ring and used to secure a strap, e.g. a football helmet strap, to a conventional flanged stud attached to the helmet. The method includes, in either order, the steps of forming a socket body having a cavity and a retention lip and forming a snap ring retainer member. Both the body and the retainer member are preferably formed of molded plastic material. The method further includes the steps of placing the snap ring into the cavity and inserting the retainer member into the cavity to retain the snap ring. In another aspect of the disclosure, an improved slide socket is also disclosed.

12 Claims, 4 Drawing Sheets

SLIDE SOCKET AND METHOD FOR MAKING SAME

FIELD OF THE INVENTION

This invention relates generally to detachable fasteners and, more particularly, to fasteners for securing straps.

BACKGROUND OF THE INVENTION

For at least four decades and continuing to the present, helmet chin straps, especially chin straps for football helmets, have been secured by a buckle or slide socket which snaps to a flanged stud protruding from the helmet. An equally-old type of slide socket involves a stamped metal base plate or "slide" and a roll-formed socket attached to the base plate by a rivet. The "mouth" of the socket is rolled inward to retain a wire-like snap ring, the inside diameter of which is slightly smaller than the outside diameter of the stud bead.

When the conventional slide socket is pressed to position so that the snap ring slips over the bead and engages the stud, there is an audible snapping sound which informs the wearer that the slide socket is seated. This is important for at least two reasons. In high school football, a team may draw a penalty if a chin strap is off at the start of play. And, of course, it is best to have the helmet fully secured for optimum protection of the wearer's head.

Types of slide sockets are shown in U.S. Pat. Nos. 3,237,257 (Forsberg); 1,712,976 (Blair); 2,867,811 (Jones); 2,693,625 (Van Buren, Jr.);873,128 (Holmes) and 887,209 (Mattson). The Forsberg patent is believed to be the same buckle as shown in the literature of Schutt Athletic Sales as filed with this application and as discussed below.

Conventional metal slide sockets are attended by a number of problems. One is the failure of the rivet which secures the slide and socket together. Often, such failure results from the collision of player's helmets. In the event of such a failure, the slide socket must be immediately replaced, if for no other reason (during high school play) than to avoid a penalty.

Yet another problem is that the conventional metal slide, which is relatively thin and ductile, is easy to bend or break. If bent or broken, the strap may be held insecurely or not at all. And irrespective of whether the metal slide is intact, it can inflict a cut during the inevitable helmet-slapping which occurs during contact sports including football.

Yet another problem, of lesser importance, is that even though major portions of conventional slide sockets are overlayed with a protective plating, this plating wears off or may have small surface voids where there is no plating. The absence of the protective plating (which seems more aptly described as a "flash" coating) results in rusting and corrosion of the slide socket, especially in areas near salt water.

The plastic slide socket shown in the aforementioned Schutt literature is of one-piece construction and has rounded ends and edges. Its molded cavity and rim are sized and shaped to snap over and receive the stud bead. The rim has an inside diameter slightly smaller than that of the bead to provide snap action. However, even though it seemingly solves the cutting and breaking problems attending metal slide sockets, the Schutt-/Forsberg socket introduces new problems of its own.

Specifically, the rim tends to wear or "round out" with repeated use. And the rim and cavity may also tend to elongate since the usual way of releasing a slide socket is to lift one end until it unsnaps. Eventually, the prior art socket loses its ability to retain the strap and must be replaced.

Clearly, an improved slide socket which avoids "rounding out," which is rust and corrosion proof, which is devoid of rivets and which is made by an innovative method would be an important advance in the art.

OBJECTS OF THE INVENTION

An object of the invention is to provide an improved slide socket and method for making such socket which overcomes some of the problems and shortcomings of the prior art.

Another object of the invention is to provide an improved slide socket which is devoid of rivets.

Still another object of the invention is to provide an improved slide socket highly resistive to bending and breaking.

Another object of the invention is to provide an improved slide socket which helps avoid injuries during play.

Yet another object of the invention is to provide an improved slide socket which requires no protective coating.

Another object of the invention is to provide an improved slide socket which does not "round out" during use.

Still another object of the invention is to provide an improved slide socket which uses a conventional snap ring to engage a helmet stud.

Another object of the invention is to provide an improved method for making the innovative socket. How these and other objects are accomplished will become more apparent from the following detailed description and the drawing.

SUMMARY OF THE INVENTION

An aspect of the invention involves a method for making an improved slide socket. Such socket, having an internal snap ring, is used to detachably secure a strap, e.g., a football helmet strap, to a flanged stud on the helmet.

The method includes, in either order, the steps of forming a socket body having a cavity and a retention lip and forming a snap ring retainer member. The method also includes the steps of placing the snap ring into the cavity and inserting the retainer member into the cavity to retain the snap ring.

The socket body forming step includes shaping the cavity to include a stop shoulder limiting the depth of insertion of the member into the cavity, the retainer member forming step includes forming the member to include a stop rim and the inserting step includes inserting the retainer member into the cavity until the stop rim contacts the stop shoulder. The shoulder thereby provides an abutment against which the stop rim "bottoms out" when the retainer member is inserted into the cavity.

In a highly preferred method, the retainer member forming step includes forming the member to include a projecting edge which extends a short distance toward the retention lip. The snap ring is thereby retained between the lip and the edge but has limited freedom of axial movement therebetween. In other words, the snap ring is free to "float" to some degree.

There are at least two ways in which the retainer member and the socket body can be coupled together. One of them, more preferred, helps assure that projecting bumps or surfaces on the finished product are minimized. The retainer member has an outer surface which is exposed when such member is in its ring-retaining position. Similarly, the socket body has a surface spaced from the retention lip. One might call this the back surface of the socket body.

The inserting step includes inserting the retainer member into the cavity until the outer surface of the member is substantially flush with the socket body surface. Since the retainer member does not then protrude significantly from the socket body, such member is less likely to be struck or accidently pulled out.

However, that is not the only way the retainer member and socket body can be arranged. In another embodiment, the retainer member forming step includes forming the retainer member to include a stop flange somewhat resembling a mushroom head in shape. The retainer member is inserted into the cavity until the stop flange contacts the body surface. That is, the stop flange has a diameter significantly greater than the diameter of the outer edge of the cavity. The body and the flange therefore "interfere" with one another to limit the depth to which the member can be inserted.

Since a properly positioned and retained snap ring is important to proper function of the improved slide socket, it is preferred that care be taken to secure the retainer member in the cavity. In a highly preferred method, the forming steps include forming the socket body cavity and the retainer member to have cooperatively-selected dimensions whereby the member is press-fitted when inserted into the cavity. That is, the member cannot be merely dropped into the cavity—some force is required to insert it. It is also preferred that the member be attached to the body to adhere thereto as well as being press fitted to one another. Sonic welding has been found to be highly suitable for the purpose.

The improved slide socket includes a socket body preferably molded of polycarbonate or other, equally durable plastic material. The body has a cavity and a snap ring retention lip, the latter at that surface of the body nearest the helmet and the flanged stud on such helmet. A snap ring retainer member is received in the cavity and a snap ring is interposed and "captured" between the member and the lip.

Although the ring is retained between the lip and the member, such ring has limited freedom of axial movement as described above. And since the outside diameter of the ring is somewhat less than the inside diameter of the cavity, the ring also has limited freedom of lateral movement so that when the socket is attached to the helmet flanged stud, the ring can readily center on the stud and expand slightly to snap over the stud.

Since further details of the inventive socket are, by now, apparent from an analysis of the inventive method, they will be mentioned only briefly. The cavity has a stop shoulder limiting the depth to which the retainer member is received in the cavity in that such shoulder and a stop rim on the retainer member contact one another when the retainer member is fully received or "seated" in the cavity.

A highly preferred retainer member also includes an annular edge projecting toward the retainer rim to retain the snap ring between the lip and the edge. The retainer member has an outer surface (that which is visible after the socket is assembled) and in the preferred arrangement, the outer surface of the member is substantially flush with the socket body surface. In another embodiment (somewhat less preferred than that described above), the retainer member includes a round, radially-extending stop flange. The socket body has a surface spaced from the retention lip and the stop flange contacts the body surface when the retaining member is seated in the cavity.

Further details regarding the inventive method and slide socket are set forth below.

DETAILED DESCRIPTION OF PREFERRED EMBODIMENTS

A primary use for the inventive slide socket 10 is to secure the strap of a football helmet and the slide socket 10 and method will be described in connection with such a helmet. However, it should be appreciated that such slide socket 10 can be used to secure straps on other headgear products as well as those on non-headgear products.

Figure 9:
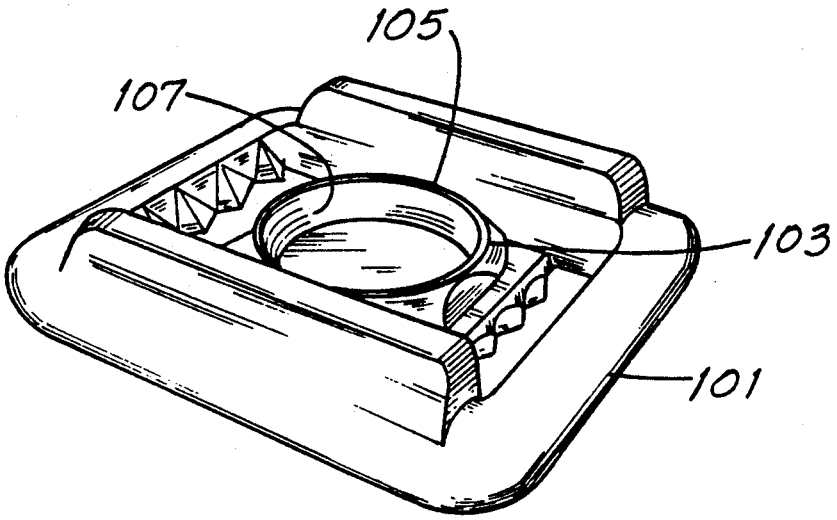
FIG. 9 PRIOR ART
FIG. 9 is an isometric view of a prior art plastic buckle. All views are enlarged.
Figure 6:
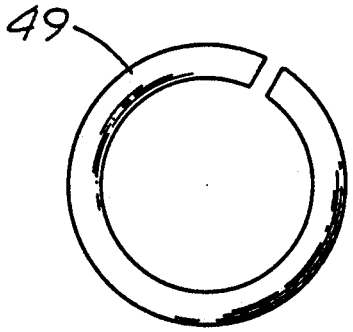
FIG. 6 is a top plan view of a conventional snap ring.

Aspects of the inventive method and slide socket 10 will be better appreciated by first having an understanding of a buckle (as such products are sometimes called). FIG. 9 shows a prior art, one-piece molded plastic buckle 101 having a raised crater-like mouth 103. The edge 105 of such mouth 103 is curved radially inward to a slight degree and the inner wall 107 of the mouth 103 is slightly concave.

Figure 8:
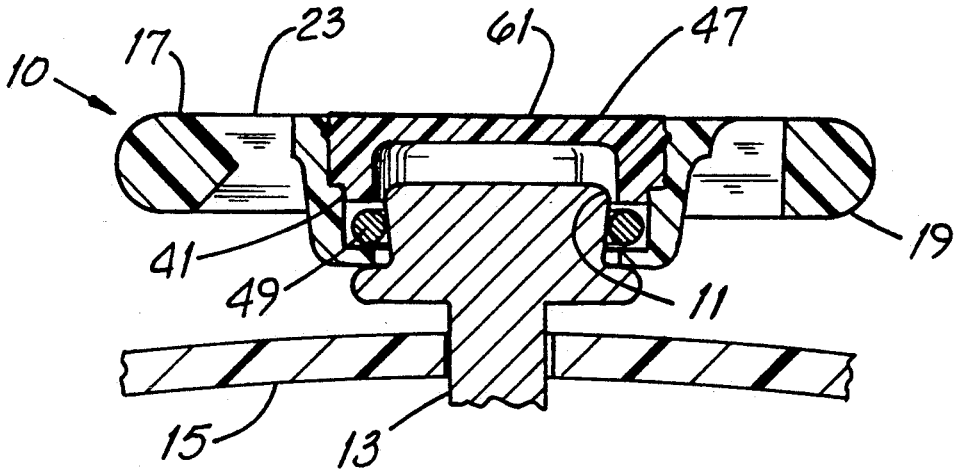
FIG. 8 is a cross-section view of the improved slide socket attached to a conventional flanged stud mounted on an exemplary helmet. Such view is generally in the same perspective as that of FIG. 3 and has parts broken away.

Referring also to FIG. 8, the inside diameter of the edge 105 is selected to be slightly smaller than the bead portion 11 of the flanged stud 13 attached to the helmet 15. When the mouth 103 of the socket 101 is urged onto the stud 13, the edge 105 audibly "snaps" over the bead portion 11.

As mentioned above, a serious flaw of such prior art buckle 101 is that the edge 105 tends to "round out" with repeated use. Such rounding will likely be to a degree that the buckle 101 will no longer firmly secure the strap to the stud 13 or, in an extreme case, may not stay attached to the stud 13 at all. And in either event, placement of the buckle 101 onto the stud 13 is less audible (or not audible at all). The user is thereby unnecessarily deprived of an important "signal" that the buckle is in place.

Figure 1:
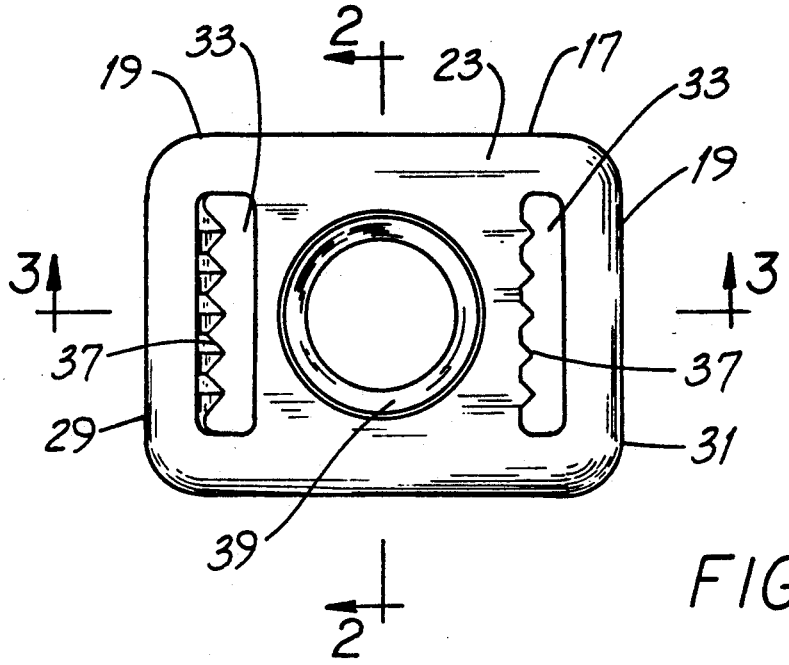
FIG. 1 is a top plan view of the body of the improved slide socket with the outer body surface toward the viewer.
Figure 2:
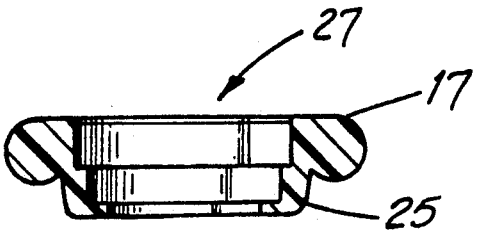
FIG. 2 is a cross-section view of the body of FIG. 1 taken along the viewing plane 2—2 thereof.
Figure 3:
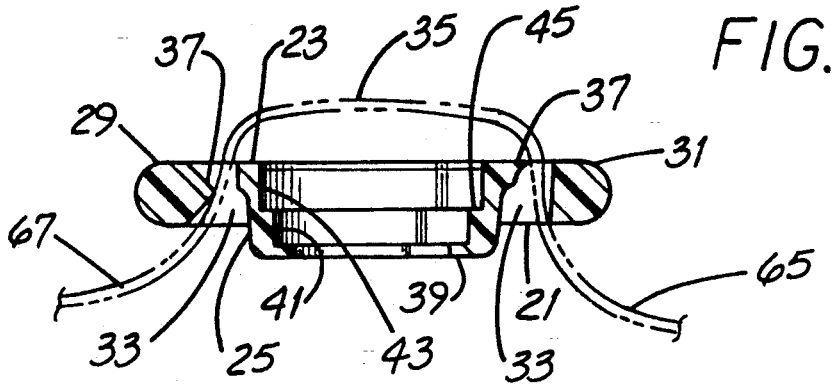
FIG. 3 is a cross-section view of the body of FIG. 1 taken along the viewing plane 3—3 thereof and including a portion of a helmet strap in phantom outline.

Referring now to FIGS. 1-3, the improved slide socket 10 includes a body 17 which is generally rectangular and unlike a conventional flat metal slide socket, has exterior rounded edges 19 to help avoid cutting injuries. The body 17 has a proximate side 21 and an outer body surface 23, so named since the side 21 and the surface 23 are, respectively, closer to and farther from the helmet 15 when the socket 10 is in use and attached to the stud 13.

The body 17 also includes a boss 25 extending from the proximate side 21 and, when the socket 10 is attached, toward the helmet stud 13. Such boss 25 is generally cylindrical and hollow. Further details of such boss 25 and of the cavity 27 formed in it are set forth below.

The body 17 has first and second ends 29 and 31, respectively, and each end 29, 31 includes a generally rectangular, slot-like opening 33 through which the strap 35 extends when the socket 10 is in use. Each opening 33 includes a set of strap-engaging teeth 37 and the manner of using the socket 10 and the role of the teeth 37 in such use is described below.

At that portion of the boss 25 nearest the proximate side 21, the cavity 27 is partially bounded by a radially inwardly extending snap-ring retention lip 39. The diameter of the lip 39 is selected to be about the same as the diameter of the bead portion 11 so that the lip 39 fits over the bead portion 11 with application of only very light force.

The cavity 27 also includes generally cylindrical proximate and distant sides 41 and 43, respectively. Such sides 41, 43 are of slightly differing diameters, that of the distant side 43 being slightly greater. The cavity 27 is thereby shaped to define a stop shoulder 45 between the sides 41, 43. As will become apparent, in the embodiment of FIGS. 1-3, 8 the stop shoulder 45 limits the depth to which the retainer member 47 can be inserted into the cavity 27.

As shown in FIG. 8, the diameter of the proximate side 41 is selected to be slightly greater than the outside diameter of a conventional snap ring 49. When the inventive socket 10 is assembled as described below, such difference in diameters permits the snap ring 49 to have limited radial freedom of movement so that the ring 49 can "self-center" and expand slightly as it snaps over the bead portion 11.

Figure 4:
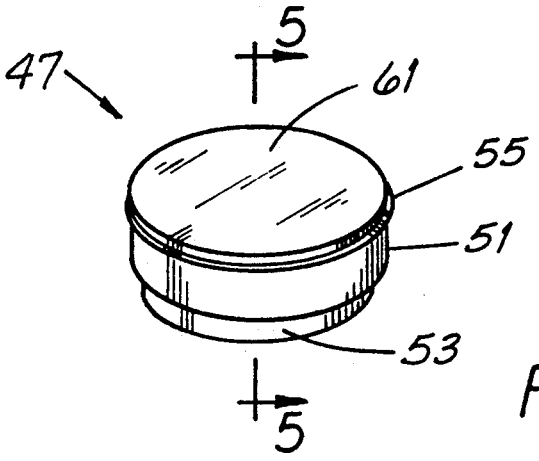
FIG. 4 is an isometric view of a preferred embodiment of the retainer member of the improved slide socket.
Figure 5:
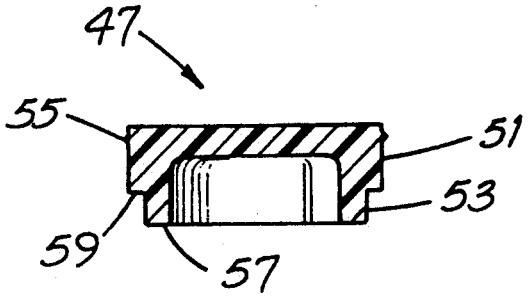
FIG. 5 is a cross-section view of the member of FIG. 4 taken along the viewing plane 5—5 thereof.

Referring now to FIGS. 4 and 5, a preferred button-like retainer member has a generally cylindrical upper barrel portion 51, lower barrel portion 53 and a slightly-raised ridge 55 about the barrel circumference. The nominal diameters of the barrel portions 51, 53 and the diameters of the sides 43, 41, respectively, are preferably cooperatively selected so that the member 47 is press-fitted when inserted into the cavity 27.

Preferably, the member 47 also has a thin, annular projecting edge 57 extending axially toward the retention lip 39. The dimension between the lip 39 and the edge 57 is selected to be slightly greater than the diameter of the stiff wire used to make the snap ring 49. In that way, the snap ring 49 also has limited freedom of movement in the axial direction, i.e., toward and away from the proximate side 21 or the outer surface 23. The barrel portions 51, 53 have differing diameters and define an annular stop rim 59 between them. Such rim 59 engages the stop shoulder 45 of the cavity 27 when the member 47 is in place in the cavity 27.

FIG. 8 shows how the retainer member 47 is inserted into the cavity 27 until the stop rim 59 contacts the stop shoulder 45 and the outer surface 61 of the retainer member 47 is substantially flush with the body surface 23. The snap ring 49 is "captured" in the cavity 27 when the retainer member 47 is seated and any rough protruding edges at the juncture of the surfaces 23, 61 are avoided.

Figure 7:
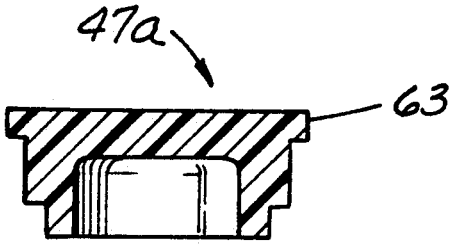
FIG. 7 is a cross-section view of another embodiment of a retainer member.

Referring to FIG. 7, another version of the retainer member **47*a* has a round, radially-extending stop flange 63 rather like a mushroom head. When such retainer member 47*a* is seated in the cavity 27, the stop flange 63 contacts the body surface 23 and limits the depth to which the member 47*a* can be inserted. Aesthetically, the retainer member 47*a* of FIG. 7 results in a slide socket 10 which is somewhat less pleasing in appearance. And it will result in a slight "bulge" beneath the strap 35 passing over it when the socket 10** is in use.

Referring next to FIG. 3, in use, the loose end 65 of a strap 35 to be secured to a helmet 15 or other object is threaded from left to right upward through the left opening 33, across the surface 23 and downward through the right opening 33 so that some short length of free end 65 extends beyond the right opening 33. It will be noted that when the strap 35 is threaded as described, tension is on that portion 67 of the strap 35 to the left of the body 17 and pulls toward the left. Therefore, the teeth 37 tend to bite into the strap 35 and hold it in a known way.

When the length of the strap 35 has been selected (by socket positioning) to be appropriate for the user, the boss 25 is placed over the stud 13 and forced toward it with sufficient force that the ring 49 snaps over the bead portion 11. An audible "click" will be heard and will inform the user that the socket 10 is in place and the strap 35 is secured. To unhook the socket 10, the free end 65 is lifted with enough force to cause the socket 10 to snap away from the stud 13.

A method for making the improved slide socket 10 includes, in either order, the steps of forming a socket body 17 having a cavity 27 and a retention lip 39 and forming a snap ring retainer member 47. The method also includes the steps of placing the snap ring 49 into the cavity 27 and inserting the retainer member 47 into the cavity 27 to retain the snap ring 49.

The socket body forming step includes shaping the cavity 27 to include a stop shoulder 45 limiting the depth of insertion of the member 47 into the cavity 27, the retainer member forming step includes forming the member 47 to include a stop rim 59 and the inserting step includes inserting the retainer member 47 into the cavity 27 until the stop rim 59 contacts the stop shoulder 45. The shoulder 45 thereby provides an abutment against which the stop rim 59 "bottoms out" when the retainer member 47 is inserted into the cavity 27.

In a highly preferred method, the retainer member forming step includes forming the member 47 to include a projecting edge 57 which extends a short distance toward the retention lip 39. The snap ring 49 is thereby retained between the lip 39 and the edge 57 but has limited freedom of axial movement therebetween. In other words, the snap ring 49 is free to "float" to some degree.

There are at least two ways in which the retainer member 47 and the socket body 17 can be coupled together. One of them, more preferred, helps assure that projecting bumps or surfaces on the finished product are minimized. The retainer member 47 has an outer surface 61 which is exposed when such member 47 is in its ring-retaining position. Similarly, the socket body 17 has a surface 23 spaced from the retention lip 39. One might call this the back surface of the socket body 17.

The inserting step includes inserting the retainer member 47 into the cavity 27 until the outer surface 61 of the member 47 is substantially flush with the socket body surface 23. Since the retainer member 47 does not then protrude significantly from the socket body 17, such member 47 is less likely to be struck or accidently pulled out.

However, that is not the only way the retainer member 47 and socket body 17 can be arranged. In another embodiment, the retainer member forming step includes forming the retainer member 47 to include a stop flange 63 somewhat resembling a mushroom head in shape. The retainer member 47 is inserted into the cavity 27 until the stop flange 63 contacts the body surface 23. That is, the stop flange 63 has a diameter significantly greater than the diameter of the outer edge of the cavity 27. The body 17 and the flange 63 therefore "interfere" with one another to limit the depth to which the member 47 can be inserted.

Since a properly positioned and retained snap ring 49 is important to proper function of the improved slide socket 10, it is preferred that care be taken to secure the retainer member 47 in the cavity 27. In a highly preferred method, the forming steps include forming the socket body cavity 27 and the retainer member 47 to have cooperatively-selected dimensions whereby the member 47 is press-fitted when inserted into the cavity 27. That is, the member 47 cannot be merely dropped into the cavity 27—some force is required to insert it.

While the inventive slide socket 10 and method have been described in connection with only a few embodiments, it should be clearly appreciated that such embodiments are intended to be exemplary and not limiting.

I claim:

1. An improved helmet buckle type slide socket including:

a circular snap ring;

a socket body having a cavity and a retention lip, the cavity having a proximate side adjacent to the retention lip, the proximate side having a generally uniform diameter slightly greater than the diameter of the snap ring;

a snap ring retainer member received and retained in the cavity, the retainer member having a lower outer, smooth-sided barrel portion of a diameter substantially equal to the diameter of the cavity proximate side, the lower barrel portion terminating in a barrel edge; and, the snap ring being interposed between the member and the lip and confined by (a) the retention lip below the ring, (b) the proximate side around the ring and (c) the edge above the ring.

2. The socket of claim 1 wherein the cavity has:

a distant side spaced from the retention lip and having a generally uniform diameter greater than the diameter of the proximate side; and, a stop shoulder between the sides and limiting the depth to which the retainer member is received in the cavity.

3. The socket of claim 1 wherein the retainer member includes a stop rim contacting the stop shoulder when the retainer member is received in the cavity.

4. The socket of claim 1 wherein the retainer member has an outer surface, the socket body has a surface spaced from the retention lip and the outer surface of the member is substantially flush with the socket body surface.

5. The socket of claim 1 wherein the retainer member includes a stop flange, the socket body has a surface spaced from the retention lip and the stop flange contacts the body surface.

6. A method for making an improved helmet buckle type slide socket having a circular snap ring, the method includes, in either order, the steps of:

forming a socket body having a cavity and a retention lip, the cavity being formed to have a proximate side adjacent to the retention lip, the proximate side having a generally uniform diameter slightly greater than the diameter of the snap ring;

forming a snap ring retainer member having a outer, smooth-sided lower barrel portion with an exterior diameter substantially equal to the diameter of the cavity proximate side, the lower barrel portion being formed to terminate in a barrel edge;

and further includes the steps of:

placing the snap ring into the cavity; and, slidably inserting the retainer member into the cavity to a position where the retainer member is retained in the cavity and the snap ring is confined and retained by (a) the retention lip below the ring, (b) the proximate side around the ring and (c) the edge above the ring.

7. The method of claim 6 wherein the socket body forming step further includes:

forming the cavity to have a distant side spaced from the retention lip, the distant side having a generally uniform diameter greater than the diameter of the proximate side, the distant side and the proximate side thereby forming a stop shoulder limiting the depth of insertion of the member into the cavity.

8. The method of claim 7 wherein the retainer member forming step includes forming the member to include a stop rim.

9. The method of claim 4 wherein the inserting step includes inserting the retainer member into the cavity until the stop rim contacts the stop shoulder.

10. The method of claim 6 wherein the retainer member has an outer surface, the socket body has a surface spaced from the retention lip and the inserting step includes inserting the retainer member into the cavity until the outer surface of the member is substantially flush with the socket body surface thereby providing a substantially smooth surface for a strap thereacross.

11. The method of claim 6 wherein the retainer member forming step includes forming the retainer member to include a stop flange.

12. The method of claim 11 wherein the socket body has a surface spaced from the retention lip and the inserting step includes inserting the retainer member into the cavity until the stop flange contacts the body surface.

* * * * *